US006652702B2

(12) United States Patent
Miyazaki et al.

(10) Patent No.: US 6,652,702 B2
(45) Date of Patent: Nov. 25, 2003

(54) INK JET RECORDING HEAD AND METHOD FOR MANUFACTURING INK JET RECORDING HEAD

(75) Inventors: Kyota Miyazaki, Tokyo (JP); Toshiaki Hirosawa, Kanagawa (JP); Osamu Morita, Kanagawa (JP); Osamu Sato, Kanagawa (JP); Kenta Udagawa, Kanagawa (JP); Shuzo Iwanaga, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 217 days.

(21) Appl. No.: 09/942,589

(22) Filed: Aug. 31, 2001

(65) Prior Publication Data

US 2002/0033858 A1 Mar. 21, 2002

(30) Foreign Application Priority Data

Sep. 6, 2000 (JP) ..... 2000/270226

(51) Int. Cl.[7] ..... B41J 2/01

(52) U.S. Cl. ..... 156/272.2; 156/275.5; 156/275.7; 156/295; 29/890.1

(58) Field of Search ..... 156/272.2, 275.5, 156/275.7, 295; 347/20, 71; 29/890.1

(56) References Cited

U.S. PATENT DOCUMENTS 5,852,456 A * 12/1998 Okada et al. ..... 347/71
6,511,162 B1 * 1/2003 Kashino et al. ..... 347/71

FOREIGN PATENT DOCUMENTS

| | | |
|---|---|---|
| JP | 9-187952 | 7/1997 |
| JP | 11-179923 | 7/1999 |
| JP | 11-188873 | 7/1999 |

* cited by examiner

*Primary Examiner*—Michael W. Ball
*Assistant Examiner*—John T. Haran
(74) *Attorney, Agent, or Firm*—Fitzpatrick, Cella, Harper & Scinto

(57) ABSTRACT

An ink jet recording head has a plurality of discharge energy generating devices for discharging recording liquid, while being provided with a recording element base plate arranged on the face opposite to the surface where the devices are arranged, having a plurality of recording liquid supply ports for supplying recording liquid to the devices, as well as with a supporting member that holds and fixes the recording element base plate. For the supporting member, a plurality of recording liquid supply paths are arranged to supply recording liquid to each of the supply ports of the recording element base plate, respectively, and then, the flow path width of each supply flow path is formed to be smaller than the opening width of inlet portion of each supply port. Further, the steps to be created between the supply flow path and the supply port is buried by the bonding agent forced out from the bonding face of the recording element base plate and the supporting member. With the structure thus arranged, the ink jet recording head is capable of optimizing the discharge characteristics of recording liquid and the supply characteristics thereof, as well as the positioning precision of a recording element base plate to a supporting member.

10 Claims, 17 Drawing Sheets

INK JET RECORDING HEAD AND METHOD FOR MANUFACTURING INK JET RECORDING HEAD

BACKGROUND OF THE INVENTION

1. Field of the Invention

The present invention relates to an ink jet recording head, and a method for manufacturing an ink jet recording head.

2. Related Background Art

A liquid discharge recording apparatus is the recording apparatus of the so-called non-impact recording type which can perform recording at high speed and use various kinds of recording mediums for recording. Then, it is characterized in that almost no noise is generated at the time of recording. For the liquid discharge recording methods adoptable for a liquid discharge recording apparatus of the kind, there is, as the typical example thereof, a method that uses an electrothermal converting device as a discharge energy generating element. The liquid discharge recording head that uses this method provides each of the electrothermal converting devices in each pressure chamber, and provides thermal energy for recording liquid when the electric pulses, which serve as recording signals, are applied to each of the electrothermal converting devices. This generates the phaseal changes of recording liquid, and then, the bubbling pressure of recording liquid exerted at the time of bubbling (at the time of boiling) is utilized for discharging recording liquid droplets.

Further, of the liquid discharge recording heads that use the electrothermal converting method, there are the one that adopts the method in which recording liquid is discharged in parallel to the base plate having the electrothermal converting devices arranged therefor (edge shooter) and the one that adopts the method in which recording liquid is discharged perpendicularly to the base plate having the electrothermal converting devices arranged therefor (side shooter).

FIG. 17 is a view which shows the state where the recording element base plate, which constitutes the background art of the application hereof, is mounted on a supporting member.

As shown in FIG. 17, a plurality of discharge ports 104*a* for discharging recording liquid are arranged on the discharge port plate 104 provided for the recording element base plate 103 on the surface side to be open in two lines in a position to face the discharge energy generating elements (electrothermal converting devices, for example) 105, and the discharge port array is structured to form one pair by two lines.

The recording liquid supply path 101*a* has a flow path width larger than the opening width of the inlet portion of the recording liquid supply port 106. As a result, the thickness of a partition wall 101*b* that partitions the recording supply paths 101*a* adjacent to each other is smaller than the pitch between the inlet portions themselves of the recording liquid supply ports 106 adjacent to each other.

There have been known several assembling methods or the like used for the manufacture of such recording element base plate as described above and the liquid discharge head that includes such base plate.

For example, in the specification of Japanese Patent Laid-Open Application No. 09-187952, an assembling method is disclosed to position the recording element base plate with respect to a method for manufacturing a liquid discharge head. This assembling method is such as to position the recording element base plate in good precision by use of vacuum adsorption fingers, and then, to fix the recording element base plate by the application of bonding agent of the type that dually uses ultraviolet and thermal hardening.

Also, in the specification of Japanese Patent Laid-Open Application No. 11-179923, a method is disclosed for bonding an orifice plate (discharge port plate) to the main body of a liquid discharge head.

Also, in the specification of Japanese Patent Laid-Open Application No. 11-188873, a method is disclosed for bonding a nozzle member to the main body of a liquid discharge head which is provided with a plurality of ink chambers.

Of the recording element base plates described above, the second recording element base plate 103, which is provided with a plurality of discharge port arrays, in particular, makes it necessary to narrow the pitches each other for the recording liquid supply port 106 in a case where the number of recording element base plates is increased to implement the cost down when the base plates are cut out from one silicon wafer or where the number of discharge port arrays 103*a* is increased without making the recording element base plate larger.

If the pitches between recording liquid supply ports 106 themselves are made smaller, there is a need for making the thickness smaller for the partition wall 101*b* of the supporting member 101 accordingly. However, if the partition wall 101*b* is made thinner, there are problems that may be encountered as given below.

(1) It becomes difficult for the ceramics supporting member 101 to form the thin partition wall less than a certain thickness from the viewpoint of manufacture.

(2) If the partition wall 101*b* is thin, the vibration waves are propagated to the adjacent supply flow path through the partition wall 101*b* when recording liquid is discharged. Then, in the adjacent supply flow path, the defective supply of recording liquid is caused to occur due to the propagated vibrations with the resultant printing defect.

(3) Further, if the partition wall 101*b* is thin, it becomes necessary to make the assembling precision higher for the recording element base plate 103 in relation to the supporting member 101 so as not to allow the adjunct supply flow paths 101*a* themselves to mix recording liquids.

On the other hand, if the partition wall 101*b* is made too thick, the width of the supply flow path 101*a* becomes narrower to make it impossible to supply recording liquid to the recording liquid supply port 106 in a sufficient amount.

Therefore, when the pitch between the recording supply ports themselves should made smaller, it is necessary to determine the thickness of the partition wall 101*b* to be formed in the supporting base plate 101 and the width of the supply flow path 101*a* in consideration of those aspects described above.

Also, for the assembling method or the like described above, which is used for the manufacture of the recording element base plate and the manufacture of the liquid discharge head that includes that of the recording element base plate, the following drawback is encountered:

(1) Of the locations having thereon the bonding agent of ultraviolet and thermal harding dural type coated, the irradiated ultraviolet rays do not reach the locations in shadows of the adsorption fingers that adsorb the recording element base plate. As a result, the recording element base plate is transferred to the next hardening process while the positioning fixation has not been completed, and the positioning of the recording element base plate is deviated eventually.

(2) The viscosity of the bonding agent of ultraviolet and thermal harding dural type applied on the location where irradiated ultraviolet rays do not reach as described above is made extremely low immediately before hardening in the thermal harding step, and then, due to the capillary force, it is transferred to the corner portions inside the recording liquid flow path. As a result, discharge nozzles are clogged.

SUMMARY OF THE INVENTION

It is an object of the present invention to optimize the discharge characteristics of recording liquid and the supply characteristics thereof, as well as the positioning precision of a recording element base plate to a supporting member.

In order to achieve the object described above, the ink jet recording head has a plurality of discharge energy generating devices 4 for discharging recording liquid, while being provided with a recording element base plate 1 arranged on the face opposite to the surface where the devices 4 are arranged, having a plurality of recording liquid supply ports 5 for supplying recording liquid to the devices 4, as well as with a supporting member 2 that holds and fixes the recording element base plate 1. For the supporting member 2, a plurality of recording liquid supply paths 2*a* are arranged to supply recording liquid to each of the supply ports 5 of the recording element base plate 1, respectively, and then, the flow path width of each supply flow path 2*a* is formed to be smaller than the opening width of inlet portion of each supply port 4. Further, the steps to be created between the supply flow path 2*a* and the supply port 5 is buried by the bonding agent 10 forced out from the bonding face of the recording element base plate 1 and the supporting member 2.

DETAILED DESCRIPTION OF THE PREFERRED EMBODIMENTS

Now, with reference to the accompanying drawings, the description will be made of the embodiments in accordance with the present invention.

(First Embodiment)

FIG. 1 to FIG. 6 are views which illustrate the head cartridge, the recording head, and the ink tanks, respectively, embodying the present invention or to which the present invention is applicable, and the relationships between them as well. Hereunder, with reference to FIG. 1 to FIG. 6, each of the constituents will be described.

Figure 1:
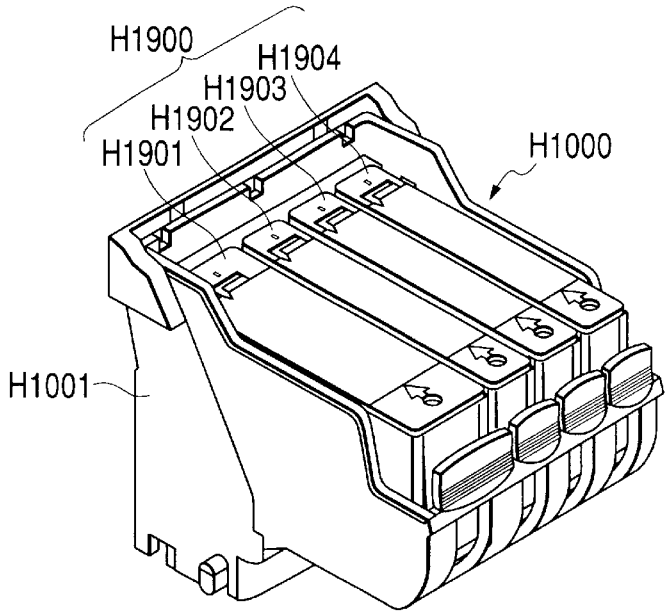
FIG. 1 is a perspective view which shows the state where a recording head and ink tanks are assembled for a recording head cartridge in accordance with one embodiment of the present invention.
Figure 2:
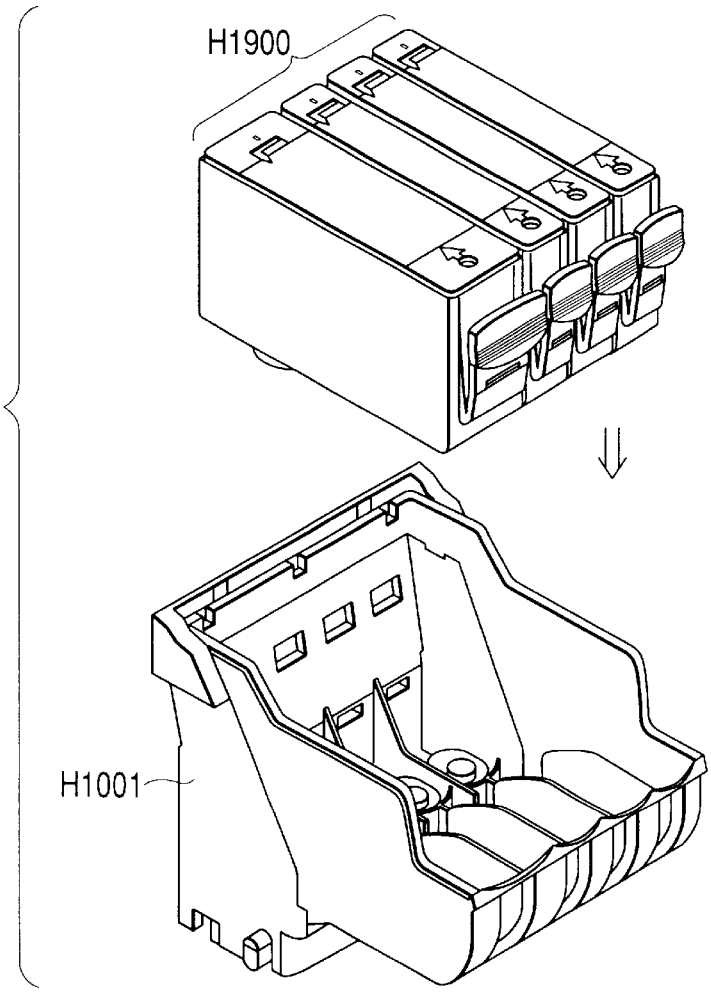
FIG. 2 is a view which shows the state where the recording head and the ink tanks are separated for the recording head cartridge in accordance with one embodiment of the present invention.

As understandable form FIG. 1 and FIG. 2, the recording head H1001 of the present invention is one constituent that forms a recording head cartridge H1000. The recording head cartridge H1000 comprises the recording head H1001, and the ink tanks H1900 (H1901, H1902, H1903, and H1904) which are detachably mountable on the recording head H1001. The recording head cartridge H1000 is supported to be fixed on the main body of an ink jet recording apparatus by positioning means and electrical contacts of a carriage (not shown), while being detachably mountable on the carriage. The ink tank H1901 is for black ink use, the ink tank H1902 for cyan ink use, the ink tank H1903 for magenta ink use, and the ink tank H1904 for yellow ink use. In this manner, the ink tanks H1901, H1902, H1903, and H1904 are detachably mountable on the recording head H1001, respectively, and each of the tanks is made replaceable to reduce the running costs of image recording by the ink jet recording apparatus.

Next, the detailed description will be made of the recording head H1001 per constituent that forms the recording head one after another.

<1> Recording Head

The recording head H1001 is the one which is called side shooter type using the bubble jet type that records using electrothermal converting devices to generate thermal energy for creating film boiling in ink in accordance with electric signals.

Figure 3:
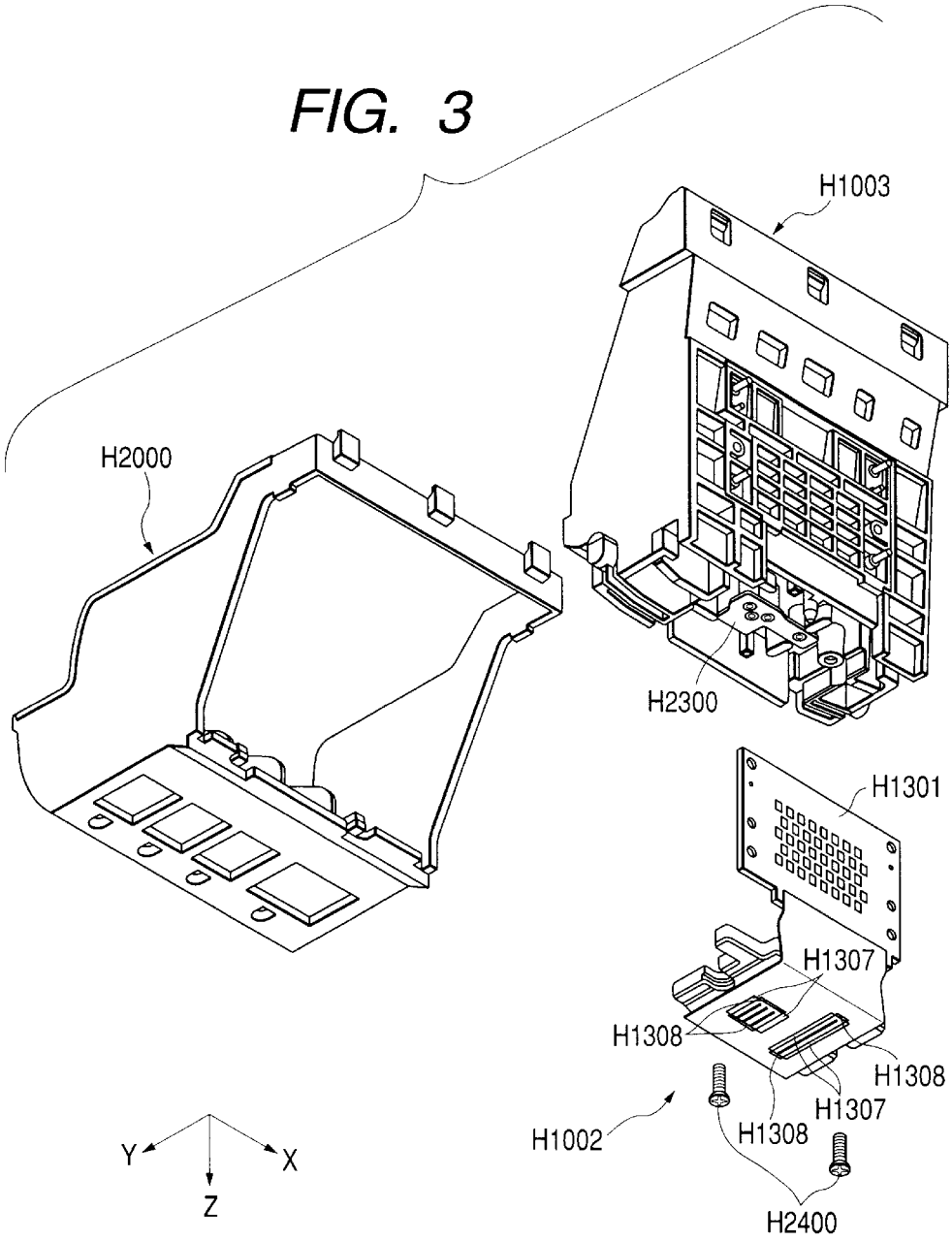
FIG. 3 is an exploded perspective view which shows the recording head cartridge represented in FIG. 1.

As shown in FIG. 3 which is an exploded perspective view, the recording head H1001 comprises a recording element unit H1002; an ink supply unit H1003; and a tank holder H2000.

Figure 4:
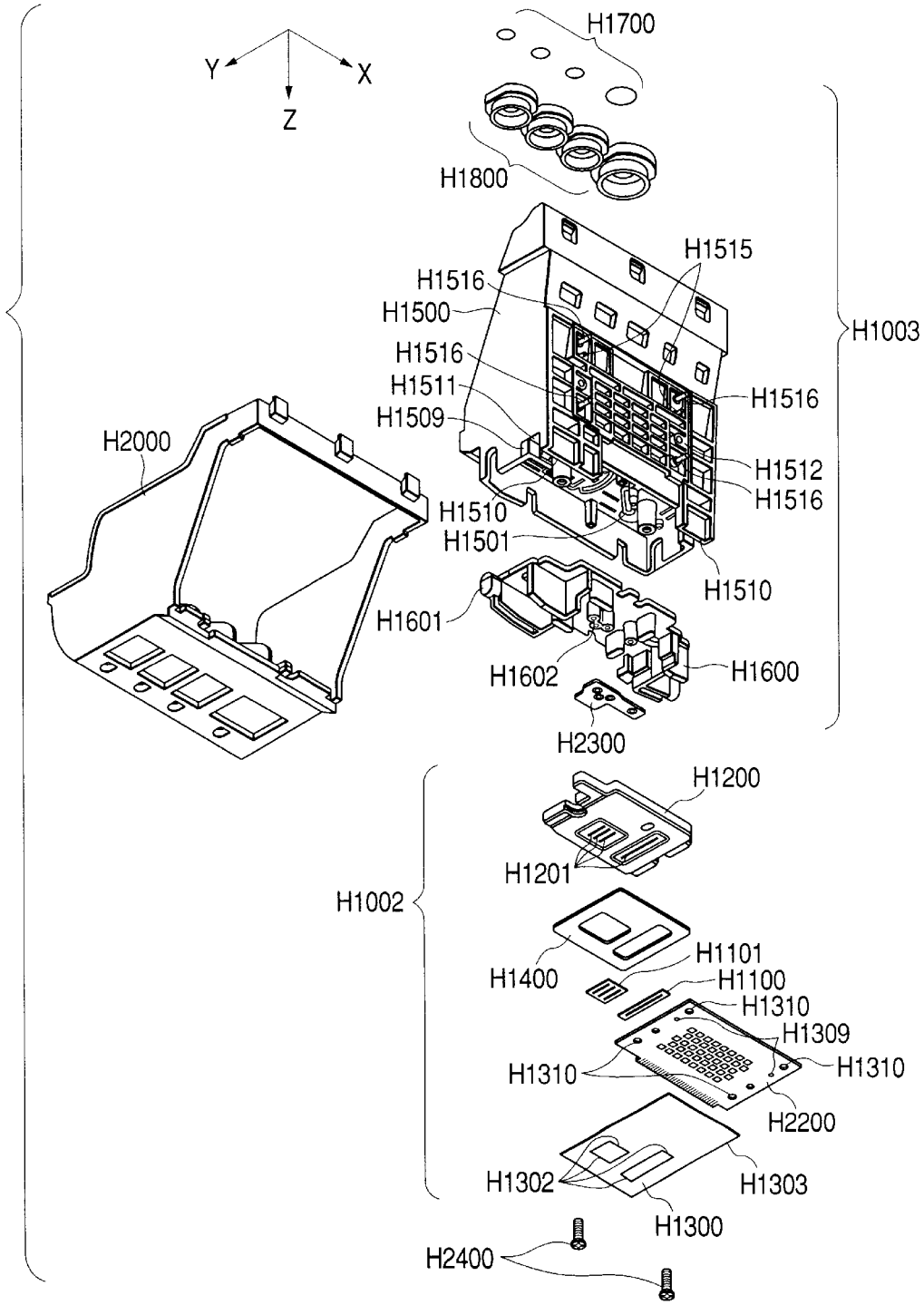
FIG. 4 is an exploded perspective view which shows the ink supply unit and the recording element unit represented in FIG. 3.

Further, as shown in FIG. 4 which is also an exploded perspective view, the recording element unit H1002 comprises a first recording element base plate H1100; a second recording element base plate 1101; a first plate H1200; an electric wiring tape H1300; an electric contact board H2200; and a second plate H1400. Also, the ink supply unit H1003 comprises an ink supply member H1500; a flow path formation member H1600; a joint rubber H2300; a filter H1700; and a sealing rubber H1800.

<1-1> Recording Element Unit

Figure 5:
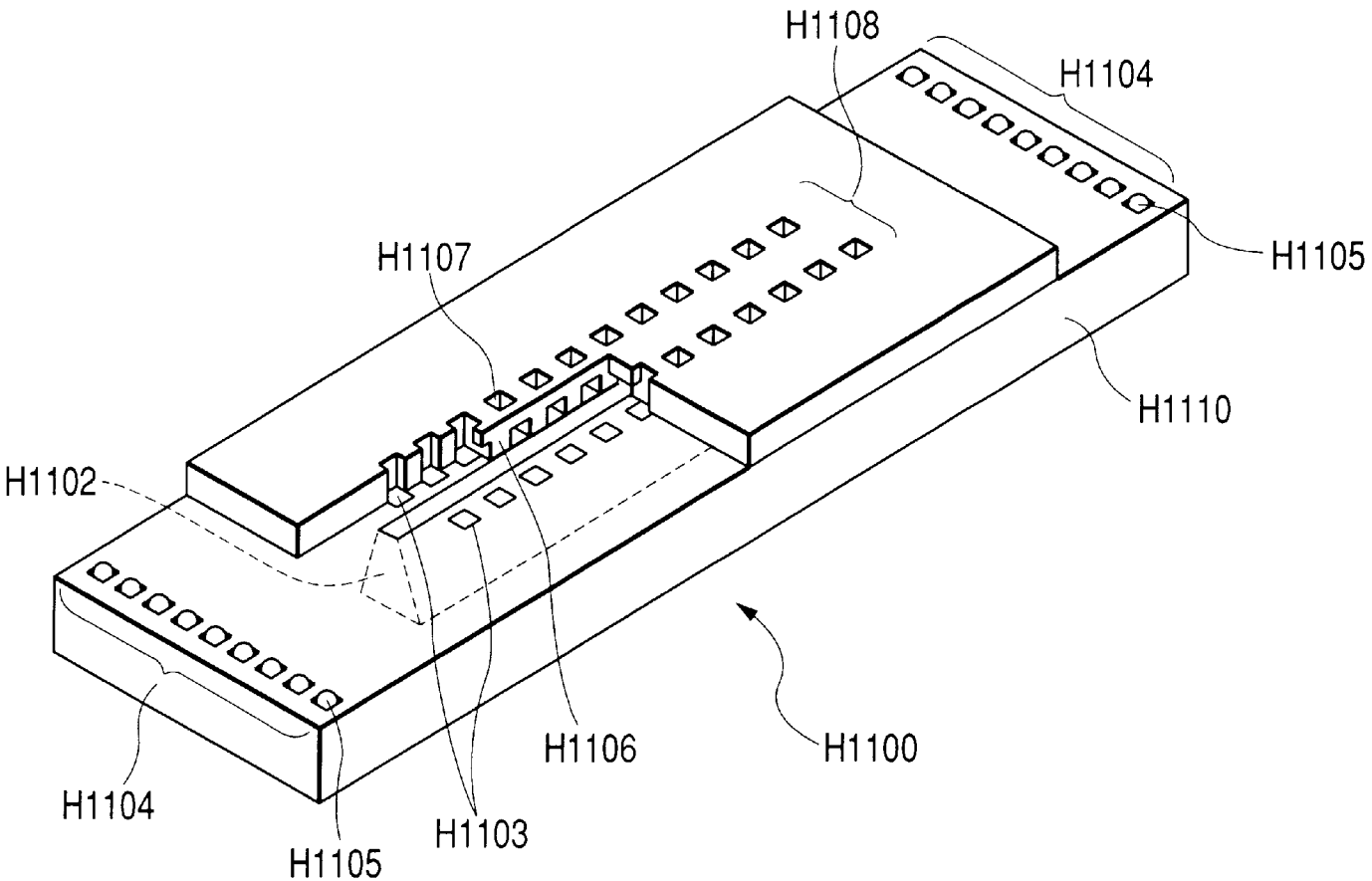
FIG. 5 is a partly broken perspective view which shows a part of the first recording element base plate represented in FIG. 4.

FIG. 5 is a partly exploded perspective view which shows the first recording element base plate H1100.

For the first recording element base plate H1100, the ink supply port H1102 is formed by the elongated through opening as the ink flow path on the Si base plate H1110 of 0.5 mm to 1.0 mm thick, for example, by means of anisotropic etching utilizing the Si crystal orientation, sand blasting, or the like. Then, on both sides across the ink supply port H1102, each of the electrothermal converting devices H1103, which serves as recording element, is arranged in zigzag each in one line. The electrothermal converting devices H1103 and the electric wiring of Al or the like that supply electric power to each of the electrothermal converting devices H1103 are formed by means of film formation technique. Further, the electrode unit H1104 that supplies electric power to the electric wiring is arranged each on the outer side of each electrothermal converting device H1103, and the bumps H1105 of Au or the like are formed for the electrode units H1104, respectively. Then, on the Si base plate, the ink flow path walls H1106 and the discharge ports H1107 are formed with resin material by means of photolithographic technique for the formation of ink flow paths corresponding to the electrothermal converting devices H1103, hence forming the discharge port array H1108. Therefore, ink supplied from the ink flow path H1102 is discharged by means of bubbles which are generated by each electrothermal converting device H1103, because each discharge port is arranged to face each electrothermal converting device H1103.

Figure 6:
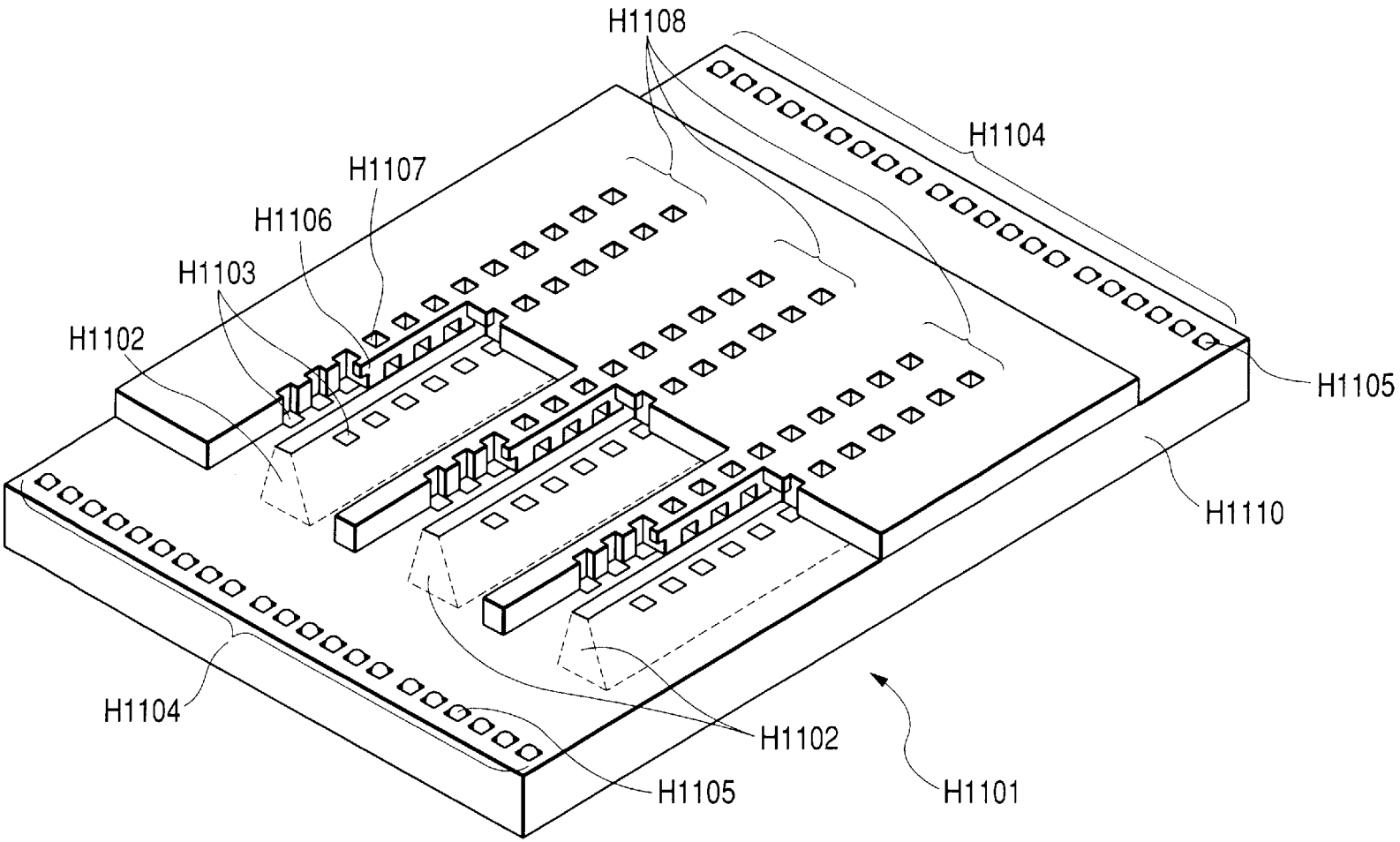
FIG. 6 is a partly broken perspective view which shows a part of the second recording element base plate represented in FIG. 4.

Also, FIG. 6 is a partly broken perspective view which shows the second recording element base plate H1101.

The second recording element base plate H1101 is the one for discharging ink of three colors. Three ink supply ports H1102 are formed in parallel, and electrothermal converting devices and ink discharge ports are formed on both sides having each of the ink supply ports between them. In the same manner as forming the first recording element base plate H1100, the ink supply ports, electrothermal converting devices, electric wiring, electrodes, and others are formed on the Si base plate, of course, and the ink flow paths and ink discharge ports are formed on them with resin material by use of photolithographic technique.

Then, as in the case of the first recording element base plate, the electrode unit H1104 and the bumps H1105 of Au or the like are formed to supply electric power to the electric wiring.

Here, reverting to FIG. 4, the first plate H1200 is formed by Alumina ($Al_2O_3$) material of 0.5 to 10 mm thick, for example. In this respect, the material of the first plate is not necessarily limited to alumina, but it may be possible to produce this plate with the material which has the same linear expansion coefficient as that of the material of the recording element base plate H1100, and also, has the same heat conductivity as more than that of the material of the recording element base plate H1100. The material of the first plate H1200 may be either one of silicon (Si), aluminum nitride (AlN), zirconium, silicon nitride ($Si_3N_4$), silicon carbide (SiC), molybdenum (Mo), and tungsten (W), for example. For the first plate H1200, there are formed the ink supply port H1201 for supplying black ink to the first recording element base plate H1100, and the ink supply ports H1201 for supplying cyan, magenta, and yellow ink to the second recording element base plate H1101. Then, the ink supply ports H1102 of the recording element base plate correspond to the ink supply ports H1201 of the first plate H1200, respectively, and then, the first recording element base plate H1100 and the second recording element base plate H1101 are positioned and bonded to the first plate H1200 to be fixed in good precision. Here, it is desirable to use the first bonding agent H1202 which has low viscosity with low hardening temperature so that it can be hardened in a short period of time, while having a relatively high hardness after hardened, as well as, a good resistance to ink. Such first bonding agent H1202 is, for example, a thermal hardening bonding agent having epoxy resin as its main component, and the thickness of the bonded layer should preferably be 50 $\mu$m or less.

The electric wiring tape H1300 is for the application of electric signals to the first recording element base plate H1100 and the second recording element base plate H1101 in order to discharge ink, and comprises a plurality of opened parts for incorporating each of the recording element base plates; electrode terminals H1302 corresponding to the electrode units H1104 on the respective recording element base plates; and the electrode terminal units H1303 to effectuate the electrical connection with the electric contact base plate H2200 which are provided with the external signal input terminals H1301 positioned on the edge portion of the wiring tape to receive electric signals from the apparatus main body. The electrode terminal H1302 and the electrode terminal H1303 are connected by use of a continuous wiring pattern of copper foil.

The electric wiring tape H1300, the first recording element base plate H1100, and the second recording element base plate H1101 are connected electrically, respectively. The connecting method is, for example, such that the electrode unit H1104 of the recording element base pate and the electrode terminal H1302 of the electric wiring tape H1300 are electrically coupled by means of thermo-ultrasonic pressurized welding.

The second plate H1400 is, for example, one-sheet plate member of 0.5 to 1.0 mm thick, and formed by metallic material, such as ceramics of alumina ($Al_2O_3$), Al, SUS, or the like. Then, this plate is configured to be provided with the opening portion larger than the contour dimension of the first recording element base plate H1100 and the second recording element base plate H1101 bonded and fixed to the first plate H1200, respectively, and also, bonded to the first plate H1200 by use of the second bonding agent H1203 so that the electric wiring tape H1300 can be electrically connected with the first recording element base plate H1100 and the second recording element base plate H1101 on the plane, thus bonding and fixing the reverse side of the electric wiring tape H1300 by use of the third bonding agent H1306.

The electrically connected portions of the first recording element base plate H1100, the second recording element base plate H1101, and the electric wiring tape H1300 are sealed by a first sealant H1307 (not shown), and second sealant H1308 in order to protect the electrically connected portions from erosion due to ink, and external shocks as well. The first sealant seals mainly the reverse side of the connected portion between the electrode terminal H1302 of the electric wiring tape and the electrode unit H1105 of the recording element base plate, and the outer circumferential portion of the recording element base plate. The second sealant seals the surface side of the aforesaid connected portion.

Further, the electric contact base board H2200, which is provided with the external signal input terminal H1301 to receive electric signals from the apparatus main body, is electrically connected with the edge portion of the electric wiring tape by means of thermally pressurized bonding using anisotropic conductive film or the like.

Then, the electric wiring tape H1300 is folded on one side face of the first plate H1200 to be bonded to the side face of the first plate H1200 by use of the third bonding agent H1306. The third bonding agent H1306 is, for example, a thermo-hardening bonding agent of 10 to 100 $\mu$m thick with epoxy resin as its main component, for example.

<1-2> Ink Supply Unit

The ink supply member H1500 is formed by means of resin molding, for example. For the resin material thereof, it is desirable to use the resin material in which glass filler is mixed in 5 to 40% for the enhancement of the form robustness.

Figure 7:
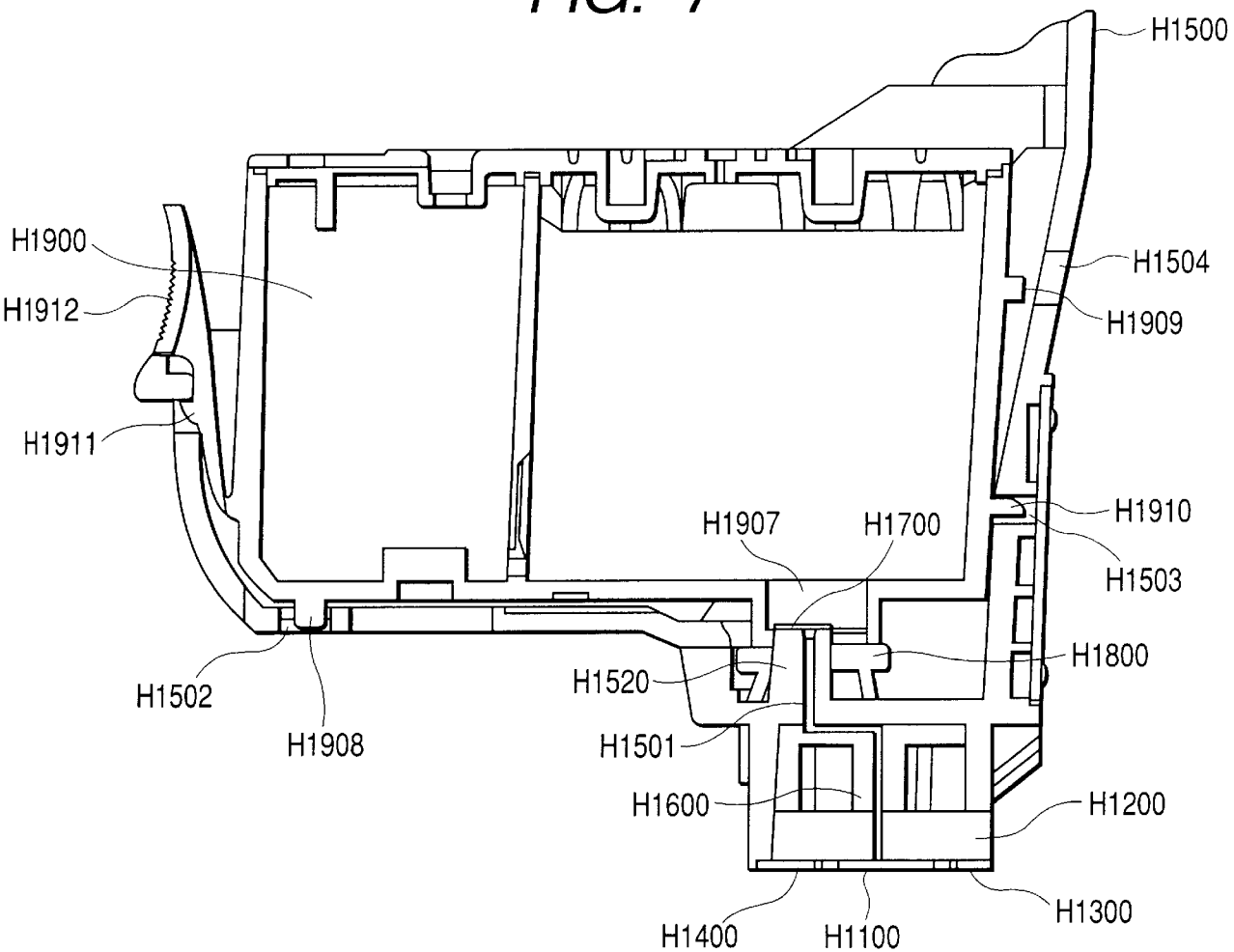
FIG. 7 is a cross-sectional view which shows the recording head cartridge represented in FIG. 1.

As shown in FIG. 7, the ink supply member H1500 is one of the constituents to form the ink supply unit H1003 that conducts ink from the ink tanks H1900 to the recording element unit H1002, and the ink flow paths H1501 are formed when the flow path formation member H1600 is welded thereto by means of ultrasonic welding. Also, to the joint H1517 that coupled with the ink tanks H1900, the filter H1700 is bonded by means of welding in order to prevent the external dust particles from entering them. Further, in order to prevent ink evaporation from the joint H1517, a sealing rubber H1800 is provided therefor.

Also, the ink supply member H1500 is partly functioned to hold the freely detachable and attachable ink tanks H1900, and also, provided with the first hole H1503 which engages with the second nail H1910 of the ink tanks H1900.

Also, as shown in FIG. 4, there are provided an installation guide H1601 to guide the recording head cartridge H1000 to the position of the carriage installation on the main body of an ink jet recording apparatus; the coupling portion H1508 where the recording head cartridge is installed and fixed to the carriage by use of a head set lever; an abutting portion H1509 for positioning the carriage in a designated position of installation in the direction X (carriage scanning direction); an abutting portion H1510 in the direction Y (recording medium carrying direction); and an abutting portion H1511 in the direction Z (ink discharging direction). Also, it is arranged to provide the terminal fixing portion H1512 that positions and fixes the electric contact base plate H2200 of the recording element unit H1002. Then, with of a plurality of ribs arranged for the terminal fixing portion H1512 and the circumference thereof, the robustness is enhanced for the surface where the terminal fixing portion H1512 is provided.

<1-3> Coupling of the Recording Head Unit and the Ink Supply Unit

As shown in FIG. 3, the recording head H1001 is completed by bonding the recording unit H1001 with the ink supply unit H1003, and further with the tank holder H2000. The bonding is executed as follows:

The ink supply port (ink supply port H1201 of the first plate H1200) of the recording element unit H1002 and the ink supply port (ink supply port H1601 of the liquid flow path formation member H1600) of the ink supply unit H1003 should be communicated without causing any ink leakage. To this end, each of them is fixed by use of screws H2400 to be fixed under pressure with the joint rubber H2300 between them. Here, at the same time, the recording element unit H1002 is positioned and fixed exactly to the standard positions of the ink supply unit in the direction X, direction Y, and direction Z.

Figure 8:
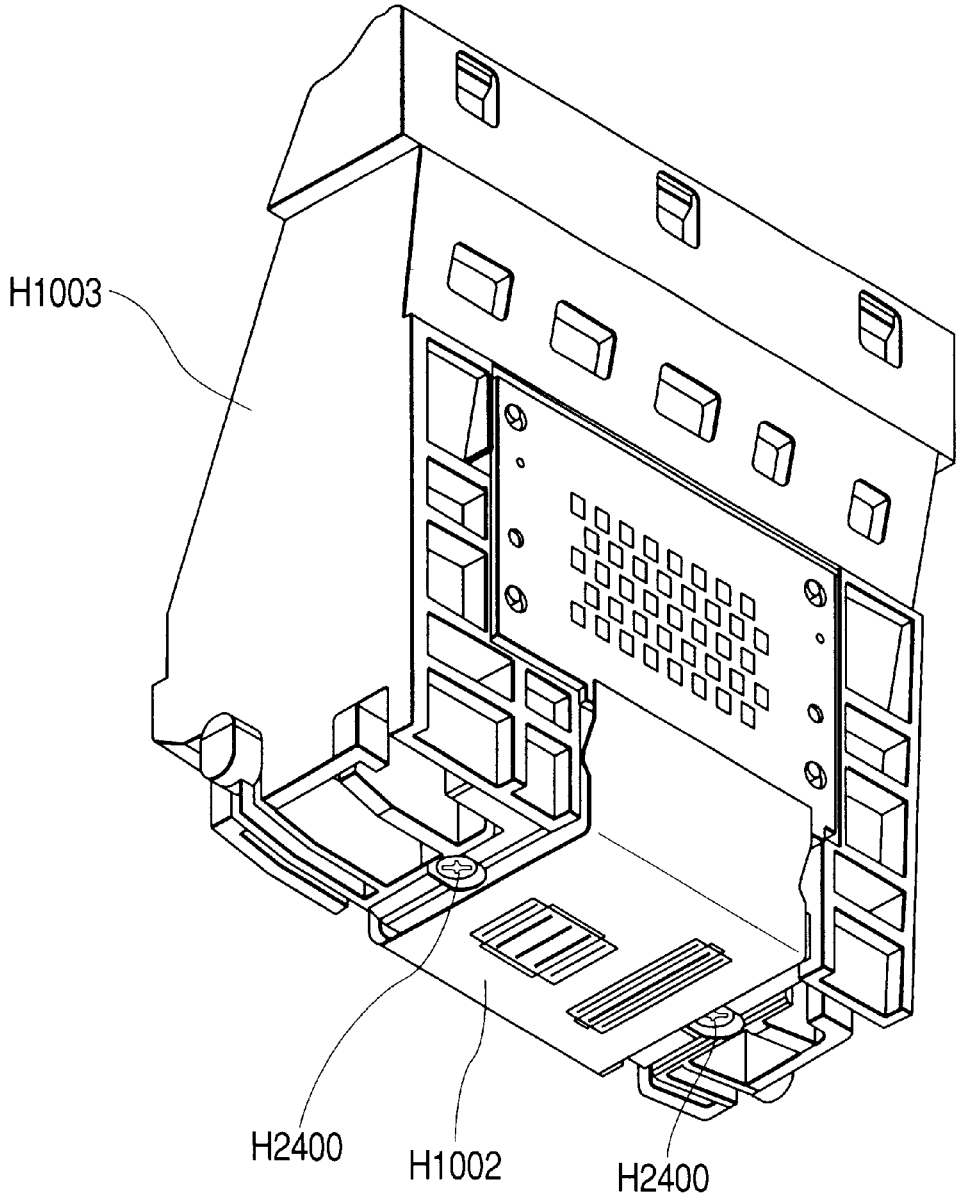
FIG. 8 is a perspective view which shows a device for coupling the recording element unit and the ink supply unit of the recording head cartridge represented in FIG. 1.

Then, the electric contact base plate H1301 of the recording element unit H1002 is positioned and fixed to one side face of the ink supply member H1500 by use of the terminal positioning pins H1515 (two locations) and the terminal positioning holes H1309 (two locations). The fixing method is, for example, such as to caulk and fix the terminal coupling pins H1515 which is provided for the ink supply member H1500, but any other fixing means may be usable. FIG. 8 shows the finished condition.

Figure 9:
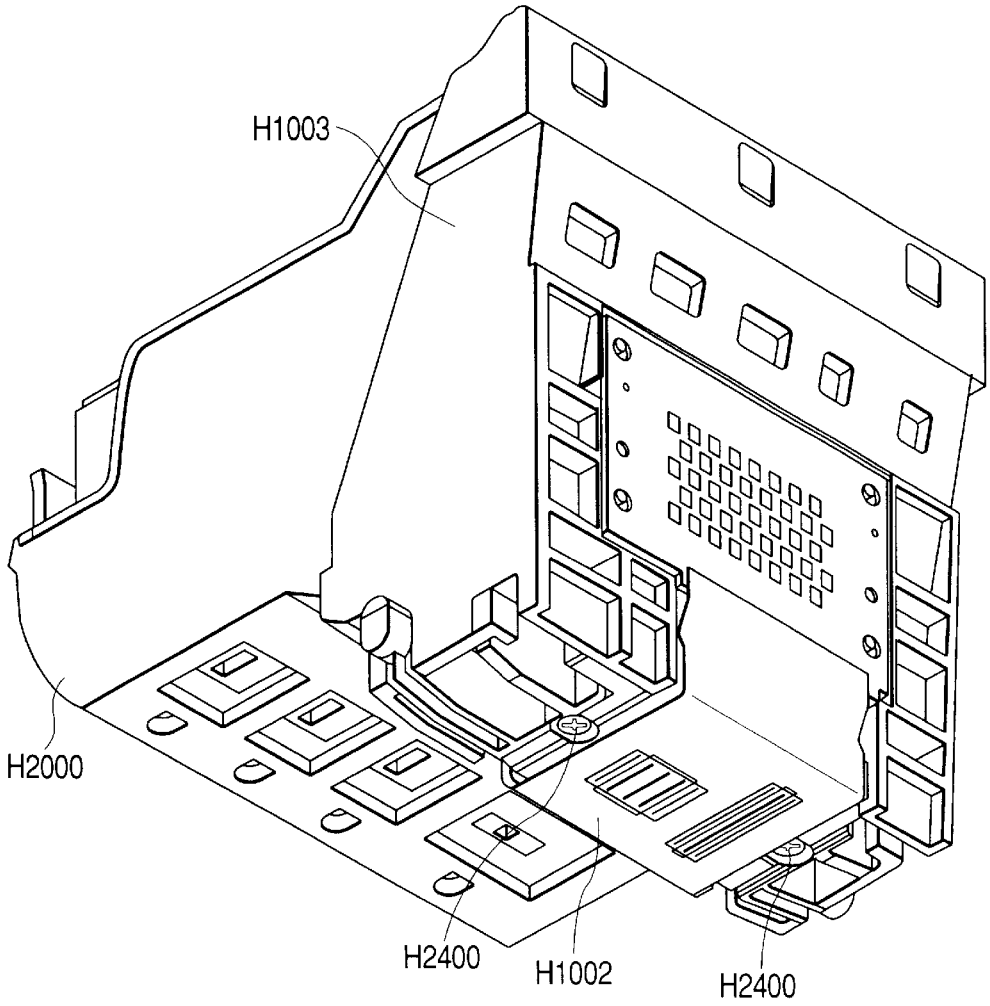
FIG. 9 is a perspective view which shows the bottom end of the recording head cartridge represented in FIG. 1.

Further, the coupling hole and coupling portion of the ink supply member H1500 with the tank holder are fitted into and coupled with the tank holder H2000 to complete the recording head H1001. FIG. 9 shows the completion thereof.

<2> Recording Head Cartridge

FIG. 1 and FIG. 2 are views which illustrate the installation of the recording head H1001 and ink tanks H1901, H1902, H1903, and H1904 which constitute a recording head cartridge H1000. Inside the ink tanks H1901, H1902, H1903, and H1904, ink of each corresponding color is contained, respectively. Also, as shown in FIG. 7, inside each of the ink tanks, the ink supply port H1907 is formed to supply ink retained in the ink tank to the recording head H1001. For example, when the ink tank H1901 is installed on the recording head H1001, the ink supply port H1907 of the ink tank H1901 is in contact under pressure with the filter H1700 installed for the joint portion H1520 of the recording head H1001. Then, black ink in the ink tank H1901 is supplied to the first recording element base plate from the ink supply port H1907 through the first plate H1200 by way of the ink flow path H1501 of the recording head H1001.

Then, ink is supplied to the bubbling chamber where the electrothermal converting device H1103 and the discharge port H1107 are arranged, and ink is discharged toward a recording sheet serving as a recording medium by the application of thermal energy generated by the electrothermal converting device H1103.

Next, of the manufacturing process of a recording head structured as described above, the description will be made of the step of fixing the first recording element base plate H1100 to the first plat H1200.

FIGS. 10A to 10C, FIGS. 11A and 11B, and FIGS. 12A and 12B are cross-sectional views which illustrate the method for manufacturing the ink jet recording head in accordance with one embodiment of the present invention. In this respect, FIG. 10A to FIG. 12B represent the section of the first recording element base plate H1100, taken in the longitudinal direction of the discharge port array thereof.

In FIG. 10A to FIG. 12B, a reference mark H101 designates the transfer pin that coats bonding agent H1202; H106, the vacuum adsorption finger that adsorbs and positions the recording element base plate; H110 and H111, the CCD cameras that recognize the position of the recording element base plate; and H112 and H113, ultraviolet irradiation nozzles, respectively.

Figure 10A:
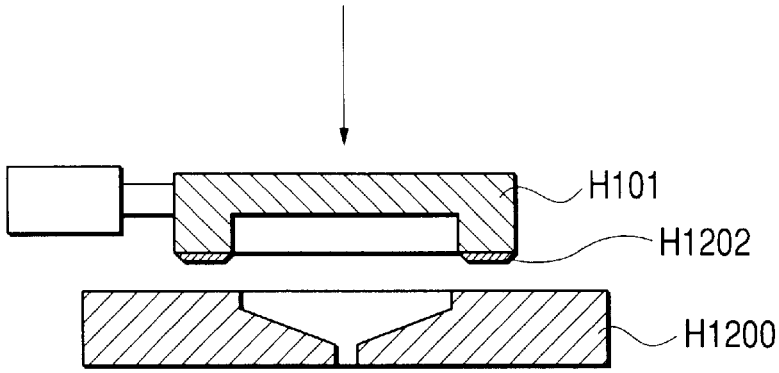
FIGS. 10A, 10B and 10C are cross-sectional views which illustrate a method for manufacturing an ink jet recording head in accordance with one embodiment of the present invention.
Figure 10B:
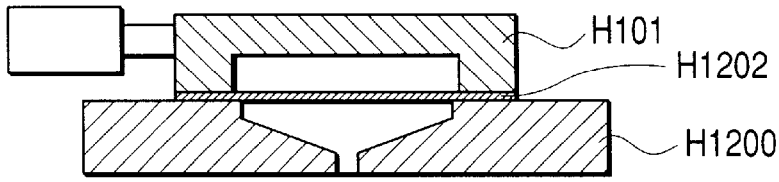
Figure 10C:
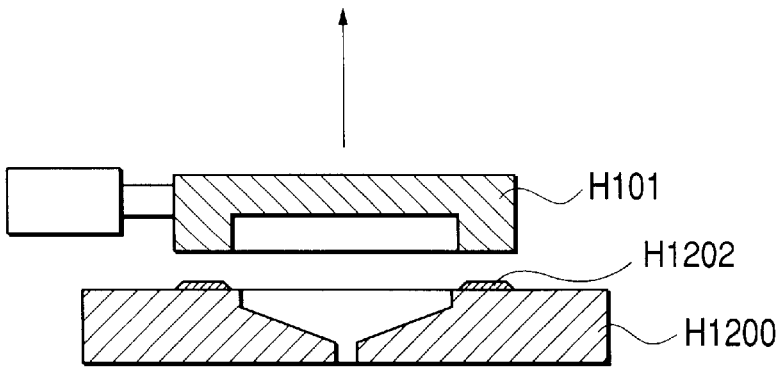

In the step of fixing the first recording element base plate H100 to the first plate H1200, the bonding agent H1202 is at first coated on the transfer surface of the transfer pin H101 as shown in FIG. 10A. Then, in continuation, as shown in FIG. 10A, the transfer surface of the transfer pin H101 is in contact with the first plate H1200. Then, as shown in FIG. 10C, when the transfer pin H101 is released from the first plate H1200, the bonding agent H1202 is coated on the bonding locations of the first plate H1200.

At this juncture, it is arranged so as to transfer the bonding agent H1202 on the first plate H1200 to the position which shifts outside the position where the first recording element base plate H1100 is in contact. The bonding agent is dual type o ultraviolet and thermal harding, that is, the bonding agent can be hardened by the irradiation of ultraviolet rays, and also, by application of heat. The bonding agent thus used has also excellent resistance to ink, and excellent transferability as well.

Figure 11A:
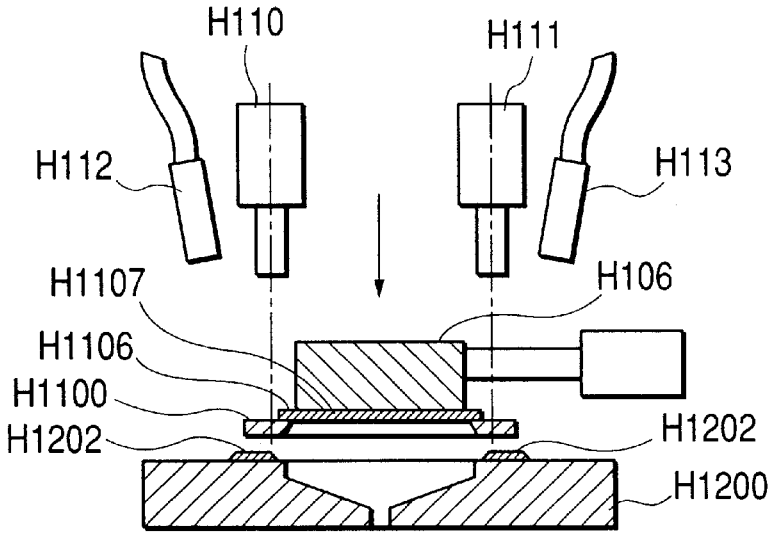
FIGS. 11A and 11B are cross-sectional view which illustrate the method for manufacturing an ink jet recording head in accordance with one embodiment of the present invention.

Next, as shown in FIG. 11A, the surface of the ink flow path wall H1106 that forms the discharge port H1107 of the first recording element base plate H1100 is held by the vacuum adsorption finger H106, and the alignment mark (not shown) of the first recording element base plate H100 is optically recognized by the CCD cameras H110 and H111 to position it with the first plate H1200.

Figure 11B:
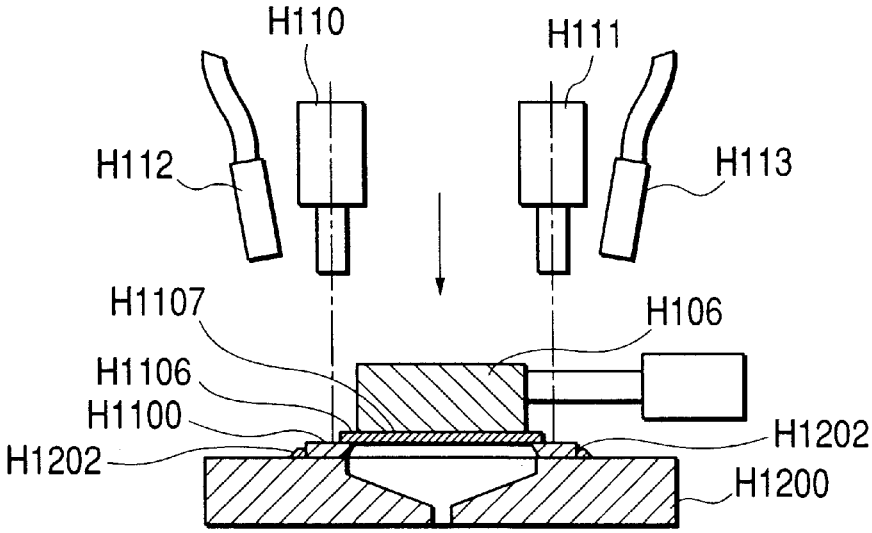

In continuation, as shown in FIG. 11B, the vacuum adsorption finger H106 thus positioned descends to enable the first recording element base plate H1100 to abut upon the first plate H1200 and compress them. Then, the bonding agent H1202 is forced out to the edge portions of the first recording element base plate H100 in the longitudinal direction as shown in FIG. 11B. In FIG. 11B, it is observable as if the bonding agent H1202 is forced out only to each outer side of ink flow path, but actually, the bonding agent is also slightly forced out inside the ink flow path (particularly in the ink supply port H1102) to be described later.

Figure 12A:
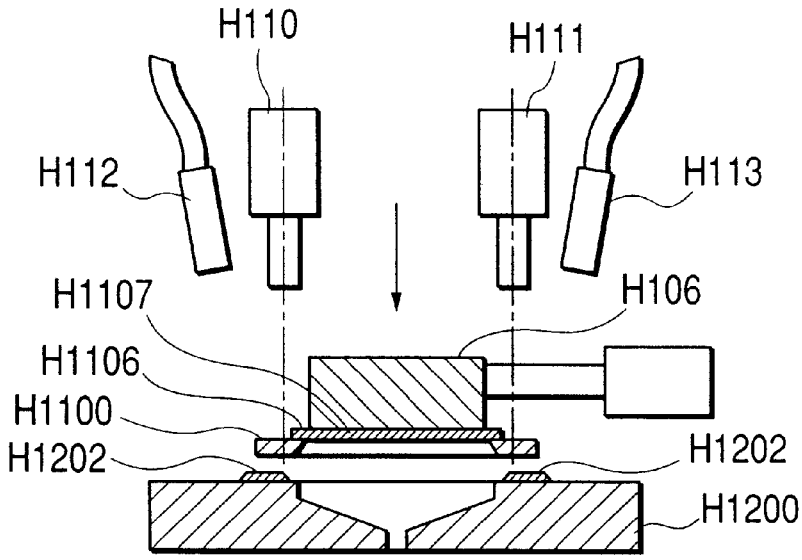
FIGS. 12A and 12B are cross-sectional view which illustrate the method for manufacturing an ink jet recording head in accordance with one embodiment of the present invention.

Then, as shown in FIG. 12A, the bonding agent H1202 forced out from the edge portions is hardened by the irradiation of ultraviolet rays from the ultraviolet irradiation nozzles H112 and H113, while keeping the first recording element base plate H1100 to be compressed to the first plate H1200. Thus, the first recording element base plate H1100 is positioned and fixed on the first plate H1200.

Figure 12B:
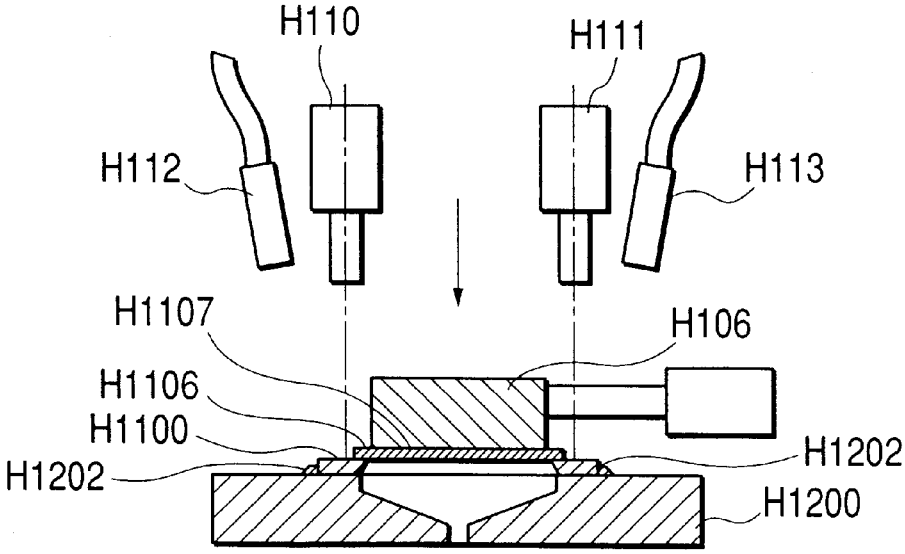

Further, after the vacuum is released and the vacuum adsorption finger H106 is moved, ultraviolet rays are again irradiated by the ultraviolet irradiation nozzles H112 and H113 from the surface of the discharge port H1107 as shown in FIG. 12B, thus hardening the bonding agent H1202 which is slightly forced out in the ink flow path (particularly, in the ink supply port H1102) in order to prevent the bonding agent from flowing out to clog the ink flow paths and discharge ports. As regards the irradiation of ultraviolet rays to the bonding agent that is slightly forced out in the ink flow path, the detailed description will be made later in conjunction with FIGS. 16A and 16B.

After the bonding process, this assembled part is further heated in order to harden the bonding agent H1202 yet to be hardened in the locations where the ultraviolet rays cannot reach.

As described above, the bonding agent is positively forced out from the bonding surface. Then, with the ultraviolet rays irradiated to such particular locations, the recording element base plate and the supporting member can be fixed tentatively. Thus, kept in the state of being positioned in high precision, the next hardening process is performed, leading to the enhancement of productivity and quality. Further, it becomes possible to irradiate ultraviolet rays to the bonding agent which is forced out into the flow paths for the performance of the firmer fixation of the recording element base plate, while preventing the bonding agent from flowing into the flow paths.

Figure 13:
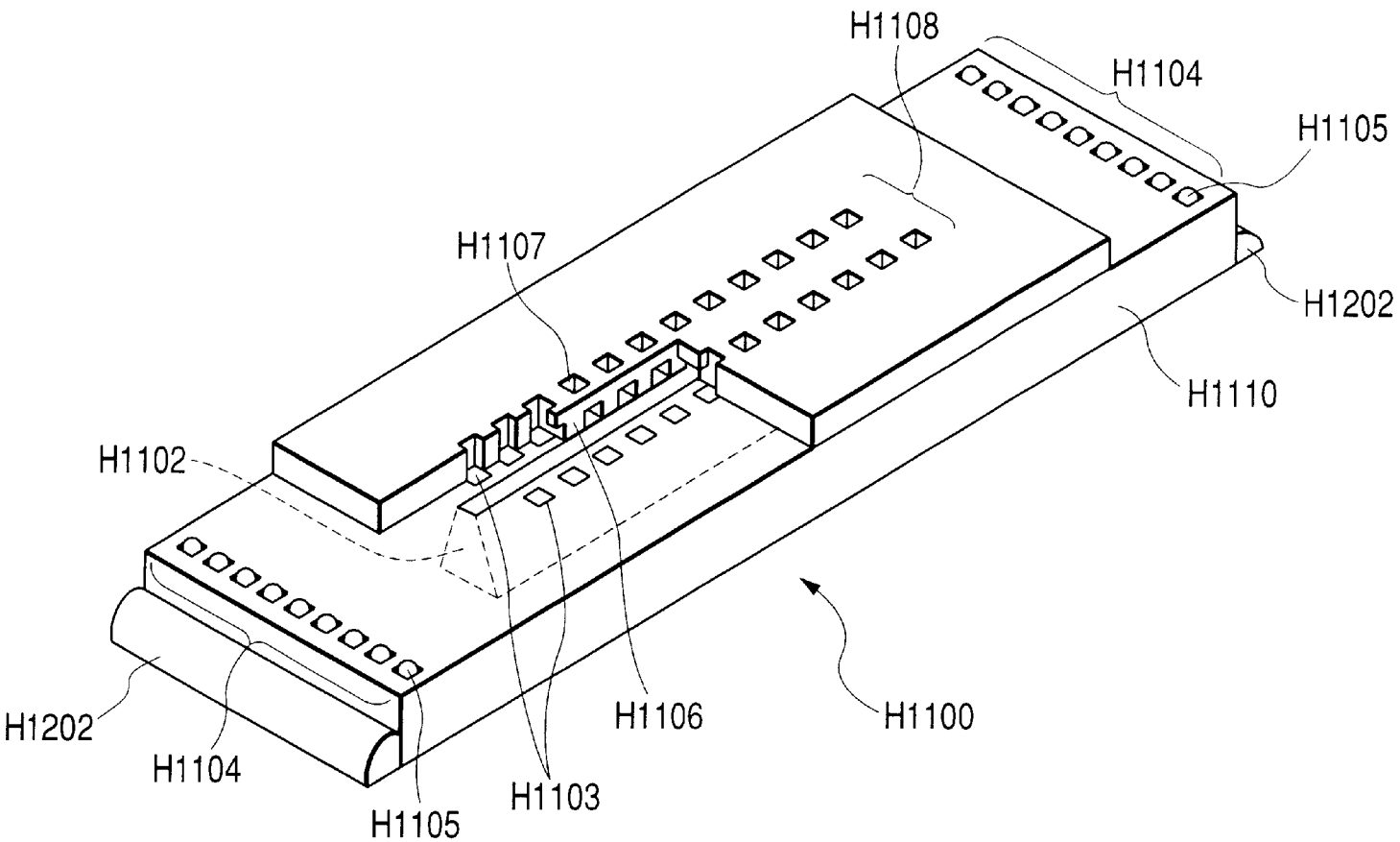
FIG. 13 is a perspective view which shows a first recording element base plate represented in FIG. 11B in the assembling step.

FIG. 13 is a perspective view which shows the first recording element base plate H1100 in the process of assembling represented in FIG. 11B.

As shown in FIG. 13, the bonding agent H1202 is forced out from the edge portions of the first recording element base plate H1100 in the longitudinal direction.

Figure 14:
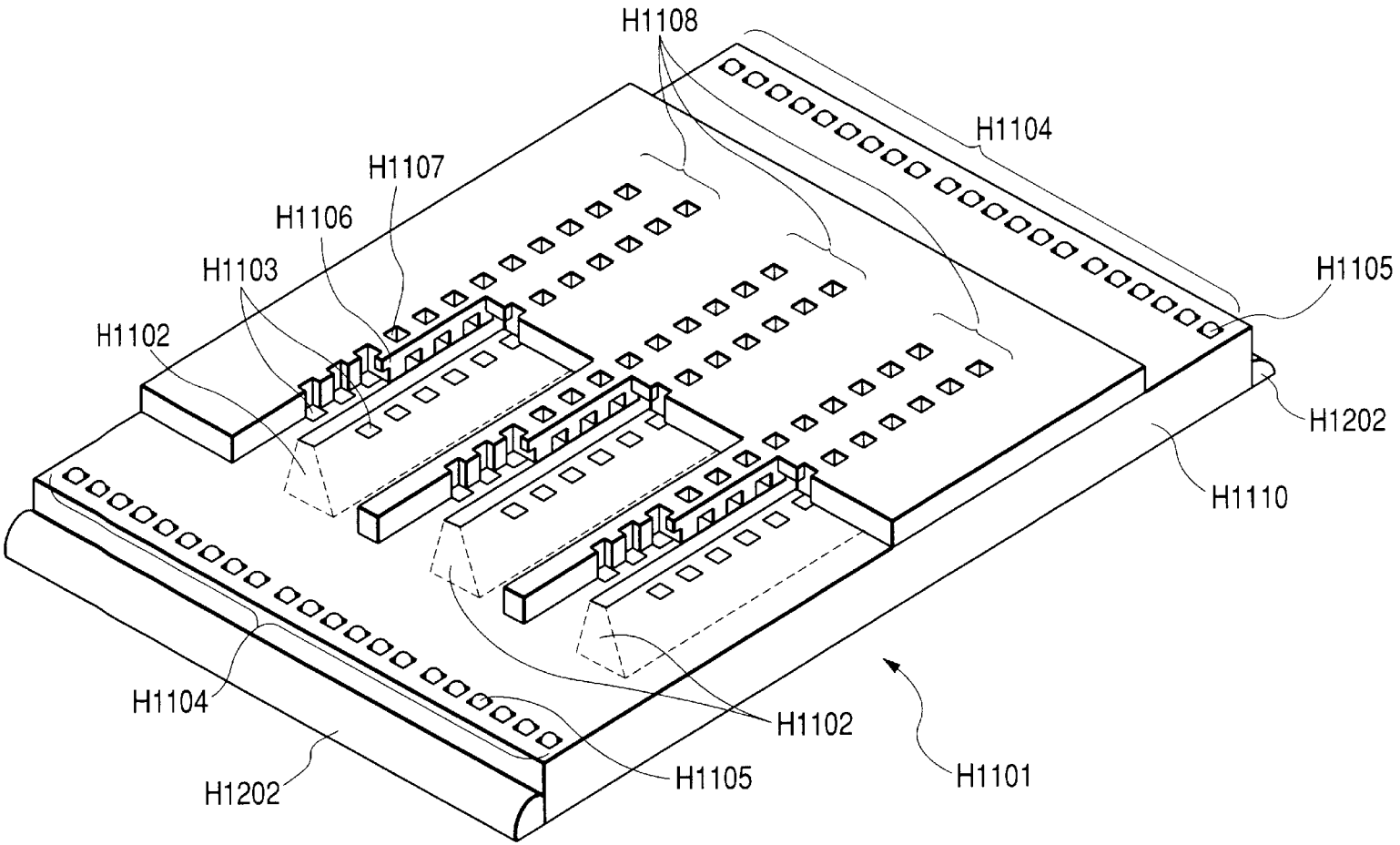
FIG. 14 is a perspective view which shows a second recording element base plate represented in FIG. 11B in the assembling step.

FIG. 14 is a perspective view which shows the second recording element base plate H1101 in the state represented in FIG. 11B in the process of assembling.

The second recording element base plate H1101 is also positioned and fixed on the first plate H1200 in the same process as the process described above. The bonding agent H1202 is forced out form the edge portions of the second recording element base plate H1101 in the longitudinal direction.

In this respect, if the thickness of the bonding agent is less than 4 $\mu$m after hardening, there is a fear that bonding defect occurs, and if the thickness of the bonding agent is more than 10 $\mu$m, the heat radiation is blocked from the recording element base plate to the first plate, and there is a fear that ink is not discharged normally. Therefore, it is desirable to set the thickness of the bonding agent H1202 between the recording element base plates H1100 and H1101, and the first plate H1200 at a value within a range of approximately 4 $\mu$m to 10 $\mu$m.

(Second Embodiment)

Figure 15:
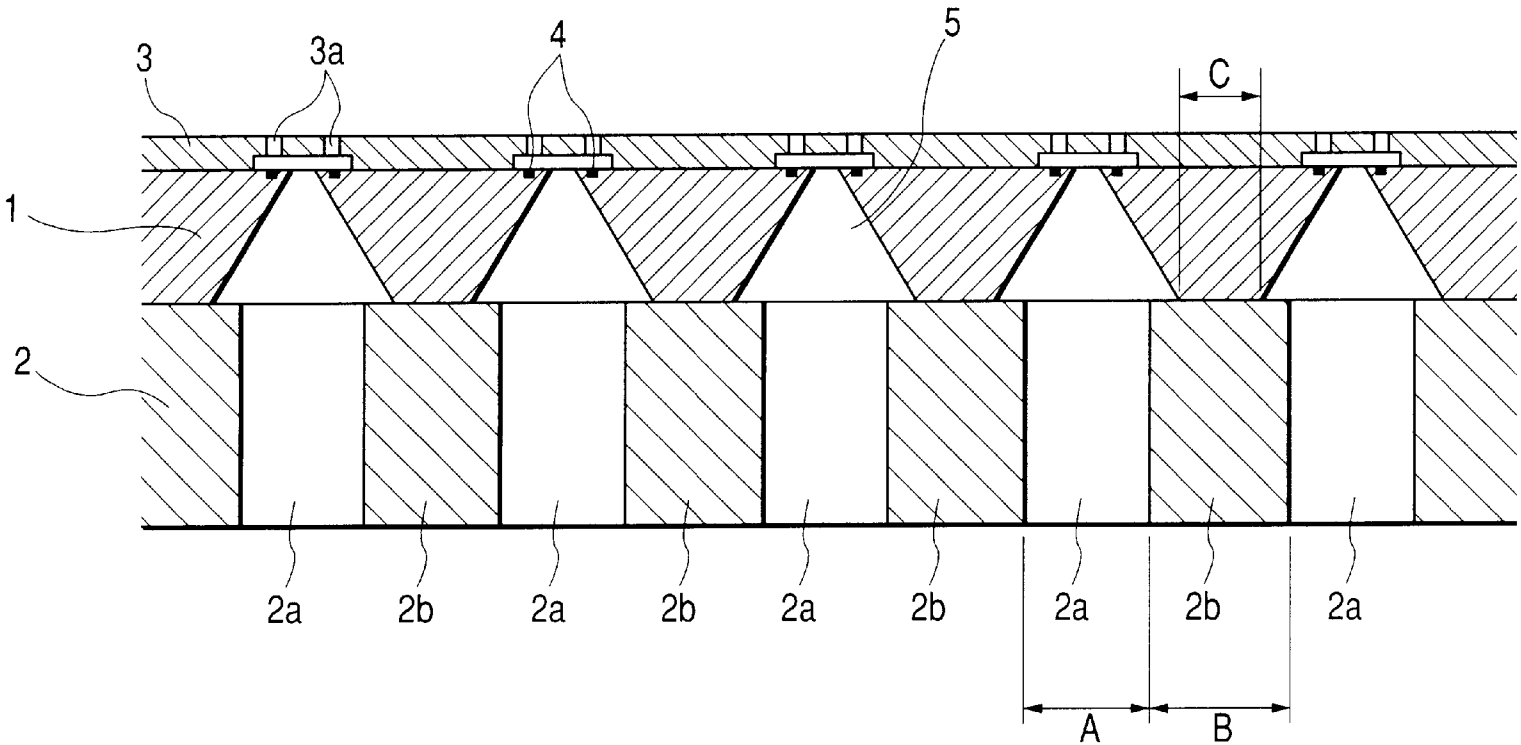
FIG. 15 is a cross-sectional view which shows the state where the recording device included in an ink jet recording head is mounted on a supporting member in accordance with a second embodiment of the present invention.

FIG. 15 is a cross-sectional view which shows the recording element included in an ink jet recording head in accordance with a fourth embodiment of the present invention in a state where it is mounted on a supporting member.

The recording element base plate 1 is arranged on the supporting member 2 with the function to discharge recording liquid by means of the electrothermal converting devices provided therefor. The recording element base plate 1 is bonded to the supporting member 2 by use of bonding resin or the like. The supporting member 2 is formed by ceramics, such as alumina ($Al_2O_3$), and the recording element base plate 1 is formed by silicon (Si).

Also, for the discharge port plate 3 provided for the recording element base plate 1 on the surface side, a plurality of discharge ports 3*a* are open in two lines in the position to face the discharge energy generating elements (electrothermal converting devices, for example) 4 which serve as recording elements. Then, the discharge port array is formed in the two lines that make a pair. On the central part of the recording element base plate 1 on the reverse side, each of the recording liquid supply port 5 is open in a length which is almost the same length of each discharge port array in the arrangement direction, which penetrates the supporting member 2 in order to supply recording liquid from the recording liquid supply flow path 2*a* to the discharge port 3*a*.

For the present embodiment, the recording liquid supply system is structured to be arranged in high density, but the main consideration is given as follows:

(1) The recording liquid supply flow path 2*a* should have a width good enough to supply a sufficient amount of recording liquid to the recording liquid supply port 5.

(2) The partition wall 2*b* of the supporting member 2 is not allowed to propagate any unfavorable influence of vibration waves to the adjacent supply flow paths 2*a* when recording liquid is discharged.

(3) The required assembling precision should not become too high when the recording element base plate 1 is assembled with the supporting member 2.

(4) The unwanted steps that may cause the bubble pools in the recording head should not be allowed to exist.

Consequently, each of the recording liquid supply paths 2*a* of the present embodiment has a width which is smaller than the opening width of the inlet portion of each of the recording liquid supply ports 5, and the thickness of each partition wall 2*b* that partitions the adjacent recording supply flow paths 2*a* is made larger than the pitch between the inlet portions themselves of the adjacent recording liquid supply ports 5. More specifically, the width A of the recording liquid supply path 2*a* of the present embodiment is set at 0.6 mm; the thickness B of the partition wall 26, 0.63 mm; the pitch C between the inlet portions themselves of the adjacent recording liquid supply ports 5, approximately 0.25 mm. Also, each of the supply ports 5 is formed in taper making the flow path width smaller as being away from the supply port 5 toward the outlet portion. Here, for the present embodiment, a five-liquid flow path system is exemplified, but the number of liquid flow paths for the system is not necessarily limited thereto.

In accordance with the present embodiment, the partition wall 2*b* is arranged to be thicker than the pitch between the inlet portions themselves of the adjacent recording liquid flow paths 5 (that is, the width of the recording liquid supply flow path 2*a* of the supporting member 2 is smaller than the opening diameter of the recording liquid supply port 5 of the recording element base plate 1). Therefore, it becomes possible to suppress the propagation of vibration waves that may be carried to the adjacent supply flow paths 2*a* through the partition wall 2*b* when recording liquid is discharged, thus enhancing the discharging preformation of recording liquid. Also, with the partition wall 2*b* arranged in a thickness larger than the pitch between adjacent recording liquid supply ports 5 themselves, there is no need for making the assembling precision high for the recording element base plate 1 with respect to the supporting member 2. In other words, this arrangement leads to the enhancement of productivity.

Figure 16A:
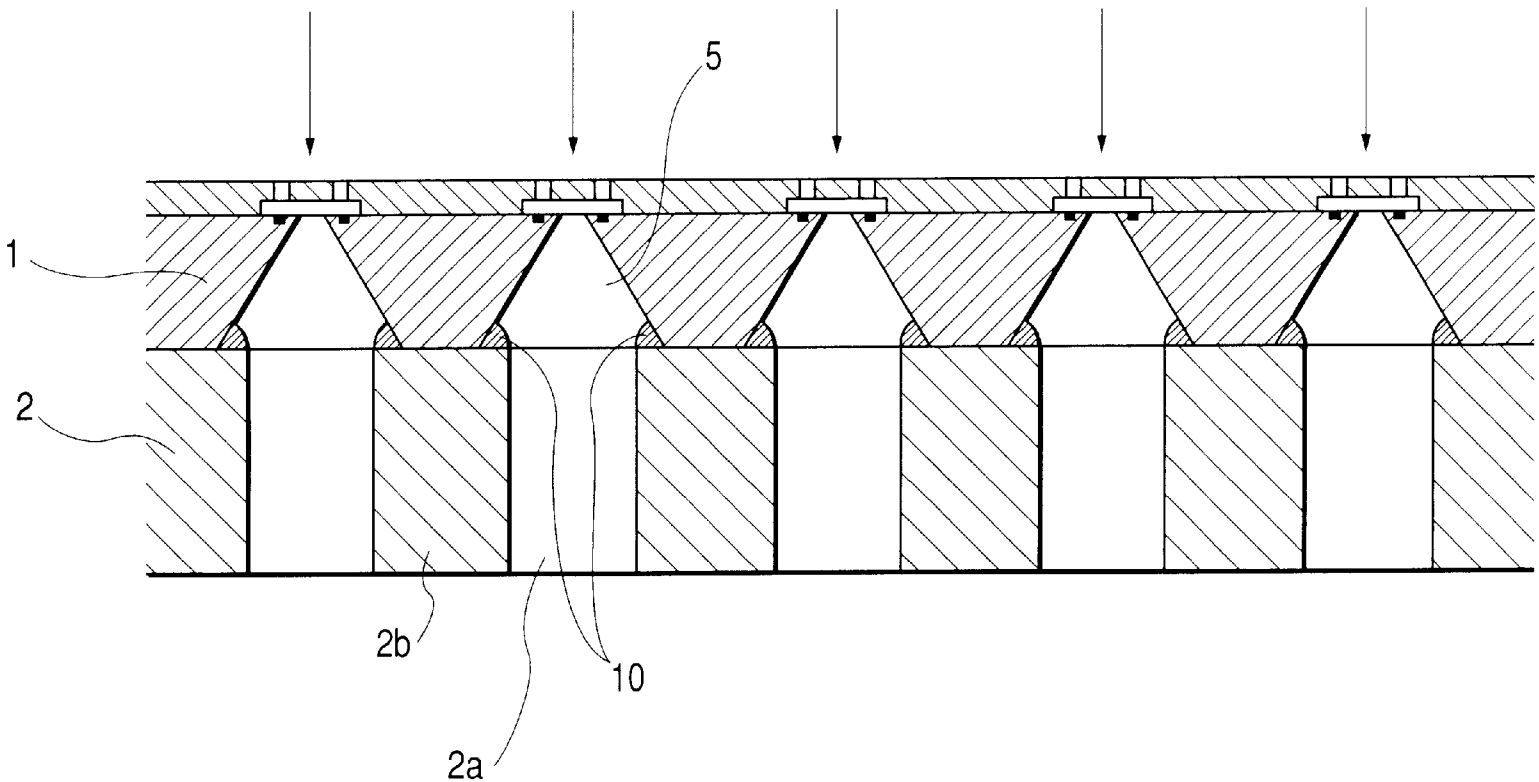
FIGS. 16A and 16B are cross-sectional views which illustrate the bonding step for the recording element base plate and the supporting member represented in FIG. 15.
Figure 16B:
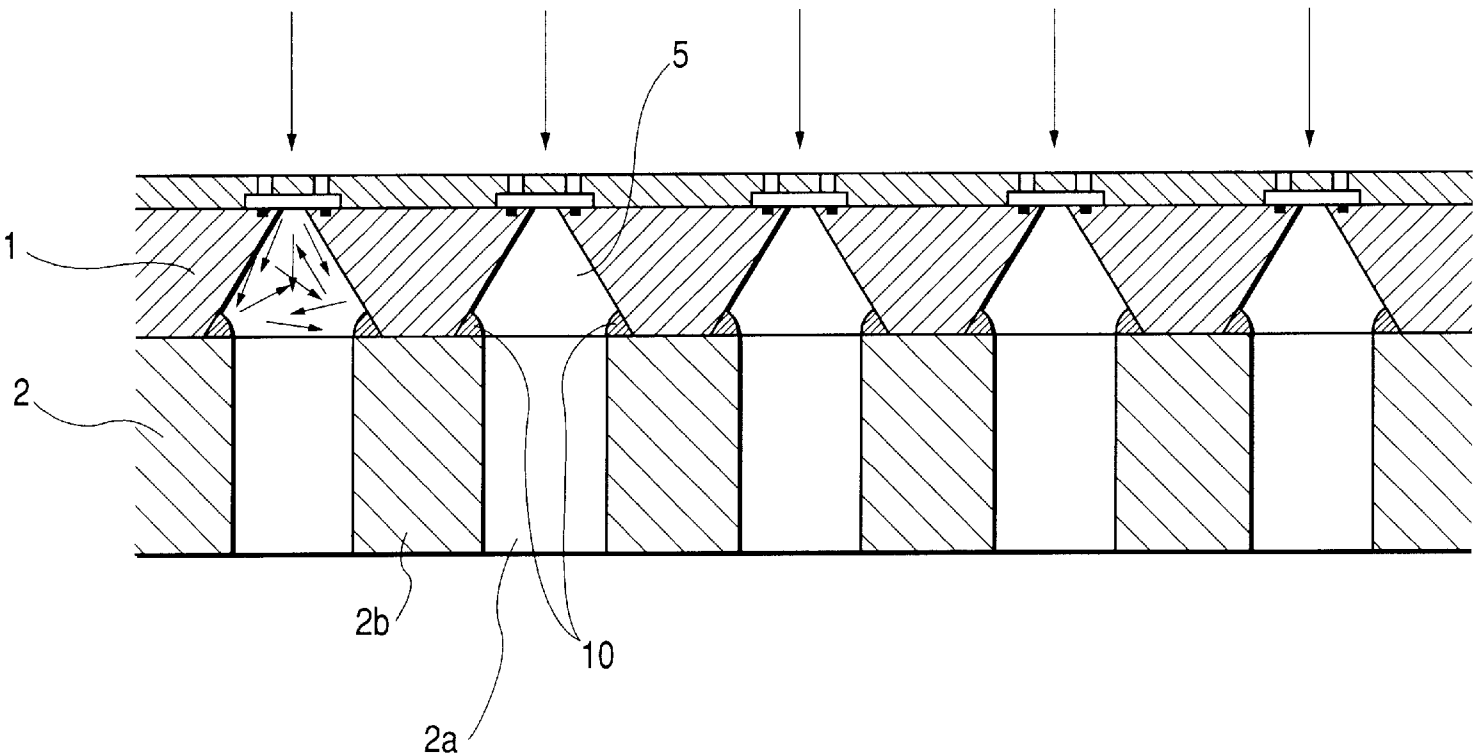
Figure 17:
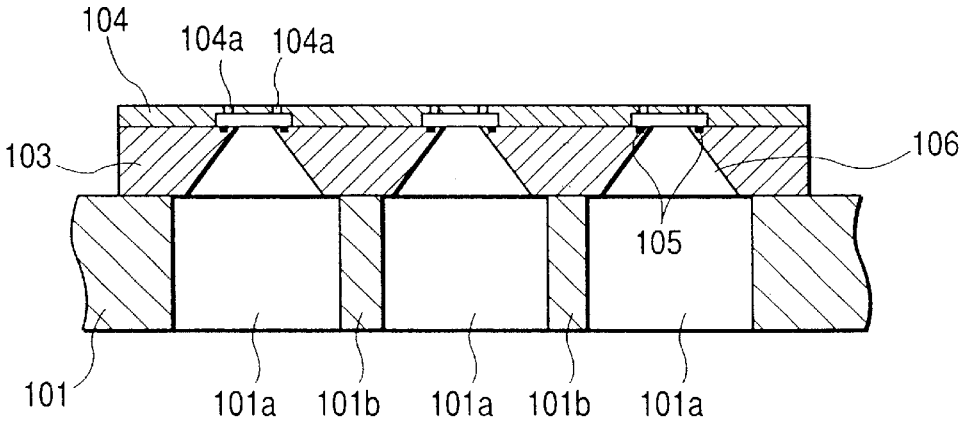
FIG. 17 PRIOR ART
FIG. 17 is a view which shows the state where the recording element base plate is mounted on the supporting member, which is the related background art of the application hereof.

FIGS. 16A and 16B are cross-sectional views which illustrate the steps of bonging the recording element base plate and the supporting member represented in FIG. 15.

For the present embodiment, the bonding agent 10 of ultraviolet (UV) light hardening type is used for bonding the recording element base plate 1 and the supporting member 2. Then, with the bonding agent 10, the step that may be created between the recording element base plate 1 and the supporting member 2 is buried to prevent unwanted liquid pools, as well as bubble pools, from being generated in the recording liquid residing in each supply flow path. For the mode in which plural lines of recording liquid supply ports are provided for one recording element base plate like the present embodiment, it becomes possible to attain making the recording element base plate having the supply ports in high density by arranging the structure as the present invention, that is, to implement the manufacture the recording element base plate at lower costs. Further, even in high density, it is possible to make the thickness of each wall between the supply flow paths of the supporting member 2 larger to a certain extent, hence preventing crosstalks, while contributing to the enhancement of productivity.

The bonding agent 10 coated on the bonding face between the recording element base plate 1 and the supporting member 2 is forced out between the upper face of the supporting member 2 and the side face of the recording liquid supply port 5, respectively, as shown in FIGS. 16A and 16B, when the recording element base plate 1 and the supporting member 2 are pressed to each other. Ultraviolet rays are irradiated from above the recording element base plate 1 to the bonding agent 10 thus forced out. Then, the bonding agent 10 is hardened, and consequently, the adjacent flow paths 2*a* themselves are sealed more reliably. Here, as shown in FIG. 16B, the discharge port plate 3 is formed by transparent resin material or the like, thus making it possible to transmit ultraviolet rays. Also, the ultraviolet rays scatters as shown in FIG. 16B when transmitted through the discharge port plate 3, and further, being diffused when reflected from the surface of the recording liquid supply port 5 and recording liquid supply flow path 2*a*, the ultraviolet rays reach the bonding agent 10 which is forced out into the recording liquid supply port of the recording element base plate, thus quickly hardening the bonding agent thus forced out.

As a result, the recording element base plate 1 and the supporting member 2 can be tentatively fixed more firmly. Further, as described earlier, the stepped portion on the bonded face between the recording element base plate 1 and the supporting member 2 can be buried by use of the bonding agent, hence preventing unwanted liquid pools, as well as bubble pools, from being generated.

For the present embodiment, the width of the recording liquid supply flow path 2*a* is made smaller than the opening width of the inlet portion of the recording liquid supply port 5. There occurs steps that may becomes liquid pools of recording liquid on each bonding portion between the supporting member 2 and the recording element base plate 1. However, as described above, each of these steps is buried with the forced-out bonding agent 10, and then, such bonding agent 10 can be hardened by the irradiation of ultraviolet rays from above the recording element base plate 1. Therefore, even if the structure is arranged to make the width of the recording liquid supply flow path 2*a* smaller than the opening width of the inlet portion of the recording liquid supply port 5, there is no possibility that liquid pools are formed in the recording liquid in the supply path. Thus, the supply performance of recording liquid is not spoiled at all.

In this respect, the bonding agent 10 usable for the present embodiment is not necessarily limited to the type of ultraviolet harding only. If the bonding agent 10 of dual type of ultraviolet and thermal harding is used, the bonding agent 10 is heated in addition to the irradiation of ultraviolet rays to the bonding agent 10 as described above, thus hardening the bonding agent 10 more reliably.

Now, the description has been made of the side shooter type of bubble jet method that uses electrothermal converting devices for generating thermal energy as the recording method for each of the above embodiments. The present invention, however, is not limited to this type. It is of course applicable to the so-called piezo-discharge method that uses electromechanical converting devices, and the ink jet head of edge shooter type, for example.

What is claimed is:

1. A method for manufacturing an ink jet recording head comprising:

a recording element base plate provided with a plurality of recording elements for discharging recording liquid, and a plurality of supply ports arranged on a face opposite to a surface having the recording elements thereon for supplying the recording liquid to the recording elements;

at least one recording element unit having a portion for incorporating the recording element base plate, and a wiring base plate to apply electric pulses to the recording element base plate for discharging the recording liquid when connected with the recording element base plate; and a supporting member for holding and fixing the recording element base plate, the supporting member being provided with a plurality of supply flow paths, a width of each of the supply flow paths being made smaller than a width of each of the supply ports formed for the recording element base plate, said method comprising the steps of:

coating on a bonding face of the supporting member a bonding agent having a property of being hardened by irradiation of ultraviolet rays and a property of being hardened by heating;

positioning the recording element base plate and the supporting member together;

forcing out the bonding agent from between the recording element base plate and the supporting member to areas of the supporting member extending out in each supply port, by pressing the recording element base plate and the supporting member to each other; and fixing the recording element base plate to the supporting member by irradiating the bonding agent forced out from the bonding face to harden the bonding agent.

2. A method for manufacturing an ink jet recording head according to claim 1, wherein a discharge port plate arranged to face the recording element base plate for discharging the recording liquid is formed from a transparent material.

3. A method for manufacturing an ink jet recording head according to claim 2, wherein said step of coating the bonding agent on the bonding face of the supporting member includes a step of coating the bonding agent on areas of the supporting member extending out from the bonding face of the supporting member.

4. A method for manufacturing an ink jet recording head according to claim 3, wherein the recording element base plate is formed in a substantially rectangular shape, and the areas extending from the bonding face are areas extending in a widthwise direction of the recording element base plate perpendicular to a longitudinal direction, on both edge portions, in the longitudinal direction, of the recording element base plate.

5. A method for manufacturing an ink jet recording head according to claim 3, wherein the recording element base plate is structured with an array of plural discharge ports for discharging the recording liquid, and the areas extending from the bonding face are areas extending out in a longitudinal direction of the discharge port array formed by the plural discharge ports.

6. A method for manufacturing an ink jet recording head according to claim 1, further comprising the steps of:

holding the recording element base plate by use of a vacuum adsorption chuck in said step of forcing out the bonding agent from the bonding face of the supporting member by pressing the recording element base plate and the supporting member to each other; and irradiating portions of the bonding agent forced out from the bonding face in said forcing out step that were blocked from irradiation due to the presence of the vacuum adsorption chuck, after moving the vacuum adsorption chuck outside of the path of the irradiation subsequent to completion of said fixing step.

7. A method for manufacturing an ink jet recording head according to claim 6, wherein the portions of the bonding agent blocked from the irradiation due to the presence of the vacuum adsorption chuck are portions arranged in the supply ports.

8. A method for manufacturing an ink jet recording head according to claim 1, further comprising the step of:

thermally hardening all of the applied bonding agent by further application of heating after the bonding agent has been hardened by the irradiation applied to the bonding agent forced out from the bonding face.

9. A method for manufacturing an ink jet recording head according to claim 1, wherein a coating thickness of the bonding agent between the recording element base plate and the supporting member is 4 to 10 $\mu$m.

10. A method for manufacturing an ink jet recording head according to claim 1, wherein an additional supporting member is arranged between the wiring base plate and the supporting member to hold and fix the wiring base plate to the supporting member.

* * * * *